US011731452B2

(12) United States Patent
Deri

(10) Patent No.: US 11,731,452 B2
(45) Date of Patent: Aug. 22, 2023

(54) REFILLABLE PENCIL ERASER CASE WITH REASSEMBLED BANDS

(71) Applicant: Michael Deri, Jerusalem (IL)

(72) Inventor: Michael Deri, Jerusalem (IL)

( * ) Notice: Subject to any disclaimer, the term of this patent is extended or adjusted under 35 U.S.C. 154(b) by 690 days.

(21) Appl. No.: 16/866,654

(22) Filed: May 5, 2020

(65) Prior Publication Data

US 2020/0361232 A1 Nov. 19, 2020

(51) Int. Cl.
*B43L 19/00* (2006.01)

(52) U.S. Cl.
CPC ..... *B43L 19/0068* (2013.01)

(58) Field of Classification Search
CPC ..... B43L 19/0056; B43L 19/0068; B43L 19/0075; B43K 29/02
See application file for complete search history.

(56) References Cited

U.S. PATENT DOCUMENTS 795,500 A * 7/1905 Faber ..... B43K 29/02 15/432
809,056 A * 1/1906 Hayes ..... B43K 29/02 14/430
2,099,613 A * 11/1937 Loewus ..... B43L 19/00 15/427
3,049,095 A 8/1962 Murray
3,261,325 A 7/1966 Lou
4,028,771 A 6/1977 Lin
5,526,548 A * 6/1996 Ostrowski ..... B43K 29/02 15/431
6,688,792 B1 2/2004 Reichmann et al.
2003/0041408 A1 * 3/2003 Fu ..... B43L 19/0075 15/433

FOREIGN PATENT DOCUMENTS

FR 2617094 A1 12/1988
IL 63028 1/2019
KR 200321360 Y1 7/2003

* cited by examiner

*Primary Examiner* — Randall E Chin

(57) ABSTRACT

A holder for a pencil eraser with removable bands. As the eraser wears, connecting bands are removed, revealing more of the eraser. As the connecting bands are removed, they are replaced at the rear end so that the length of the eraser case remains the same. When the eraser is completely worn out, a new eraser is inserted in the eraser case.

5 Claims, 18 Drawing Sheets

REFILLABLE PENCIL ERASER CASE WITH REASSEMBLED BANDS

RELATED APPLICATION/S

This application claims the benefit of priority of Israel Patent Application No. 266625 filed 14 May 2019, the contents of which are incorporated herein by reference in their entirety.

FIELD AND BACKGROUND OF THE INVENTION

The present invention relates to a refillable pencil eraser. More particularly but not exclusively, the present invention relates to refillable pencil eraser case with reassembled bands.

U.S. Pat. No. 3,261,325 appears to disclose, "erasers, and has particular reference to an eraser rolled in helical form and disposed in a holder, so as to form an eraser strip which emerges from the bottom of the holder. An eraser device for operating rolled strip erasers, comprising: an eraser holder having first and second members connected by linking means; clip means for locking the first and second members in a closed position; an eraser body of generally helical configuration disposed within the eraser holder; an eraser strip outlet tube formed in the second member and having a curved guide member thereon, said tube receiving a strip of eraser material from the helical eraser body; means for urging the eraser body towards the outlet tube; and means for selectively clamping the eraser body strip within the outlet tube."

U.S. Pat. No. 3,049,095 appears to disclose, "eraser holders and more particularly to a refillable holder for an elongated eraser element of comparatively small cross section suitable for erasing limited areas without damaging adjacent lines or characters. An eraser holder comprising in combination a housing containing an entrance channel and an exit channel each adapted to slidably receive an elongated eraser and between the two channels an opening extending transversely to said housing, a roller mounted on said housing and positioned in said opening, an elongated eraser in said channels and so mounted with respect to said roller that one surface of the eraser is approximately tangent to the periphery of the roller and another surface of the eraser projects outside of the housing for an appreciable distance opposite said open space."

U.S. Pat. No. 4,028,771 appears to disclose, "An eraser device comprising a thin flat rubberlike erasing material and a stiff plastic holder structure therefor, the latter having a trough shape holder bottom locking together by snap clips with an inverted trough shape front cover and an inverted trough shape rear cover so as to form a clamping front end and a rear storage space. The thin flat eraser is clamped firmly at the front end so as to eliminate requirement of exerting extra force or paying special attention to the holder in order to prevent the eraser from slipping backward in the erasing operation. Additionally, the holder structure provides a smooth surface for comfortably grasping the eraser device in the hand. As the eraser front end is worn in use, it can be easily adjusted to maintain the proper protrusion by releasing the clamp action of the front cover. Refilling of long flexible thin eraser can be easily accomplished by removal of both front and rear covers. Double erasing ends can be easily formed by providing a clamping zone at each end of the holder and two separated pieces of erasing material."

U.S. Pat. No. 6,688,792 appears to disclose, "A stacked marker is formed by stacking individual stackable markers where each stackable marker is a fully functional marker and each stackable marker can be selected for use and then reassembled to store the re-stackable marker. Each stackable marker is originally assembled as an otherwise ordinary marker, but with a temporary utility cap, which, upon being inserted into a rear receptacle in another marker, is left therein to form the permanent cap for other markers. When fully assembled, the stacked marker becomes a multi-unit final assembly that affords one the use of a plurality of different types of markers that are snapped together during non-use and taken apart to select individual markers during use."

French Patent 2617094 appears to disclose, "a long rubber with an accurate erasing surface (round, oval, square, rectangular surface). Easy to store, like a pen, always neat, easy to clean, economical (with or without refills). The pointed rubber comprises (see Abstract figure) a rubber stick, optionally in sections 1 inside a rigid or semirigid plastic sheath 2. Refills enable the pointed pen rubber to be reused. A tape-wound version of the pointed rubber, or one with rings, is not reusable (the rigid or semi-rigid sheath has a wound tape or pre-cut rings so that the sheath can be removed by degrees as the rubber is used up). Round pointed rubber refills usable with a propelling pencil, with diameters of 1 mm, 1.5 mm, 2 mm."

Korea (South) Patent 200321360 appears to disclose, "an eraser for a whiteboard refilling manner, the eraser 1 has a space is formed inside the plurality of wipe cloth (2) is case 3 of the box-like embedded in the laminated structure of the space is formed, and the case 3, the front face being formed with respective locking projection (4) on the left and right sides, the housing 3 engaging projection each hook (5) on its front left and right so as to be fixed becomes jammed in 4 of the that the cover (6) formed along soon as the adhesive material applied on one surface of the medium of the hinge (7) of the rear rotatably installed to the case 3, the Clear fabric (2) incorporated in the case (3) adapted to protect the adhesive material stripping sheet 8 is installed, which can be used to attach the wipe fabric 2 of the stripping sheet 8 has been removed on one side of the case (3) on the other hand, the case (3) the pulling-out of the U-shape in the front groove (9) is formed through the take-erasure PO groove 9 in the state to which the cover 6 is opened (2) as the to be drawn structure, and the white board eraser is because it is a refill type can be used by the user and easily pulled out as needed, the end of its service life in the eraser is emerging as a discarded is waste of resources and environmental pollution for It can improve the problem, and that is due to the use for a long time to replace the eraser can proceed continuously without a break lectures or meetings."

Additional background art includes U.S. Pat. No. 2,099,613 (Eraser), U.S. Pat. No. 5,526,548 (Eraser holder), U.S. Pat. No. 6,547,465B1 (Pencil with exposable eraser) and U.S. Pat. No. 809,056 (Eraser-holder).

SUMMARY OF THE INVENTION

According to an aspect of some embodiments of the invention, there is provided a method of maintaining a length of an eraser case including: assembling an elongated hollow portion of the casing of a plurality of connecting bands in front of a base band, the base band retaining an eraser in the hollow portion; removing a connecting band of the plurality of connecting bands, thus shortening the elongated hollow portion of the case and revealing a portion of the eraser; and placing the removed connecting band behind the base band as a back band thereby maintaining the length of the eraser case.

According to some embodiments of the invention, the case further includes a top band, the method further including: removing the top band before the removing the connecting band and replacing the top band at the front of the elongated hollow portion.

According to some embodiments of the invention, the method further includes: repeating the removing, placing and replacing after further wear of the eraser by removing a further connecting band from in front of the base band and replacing the connecting band behind the base band.

According to some embodiments of the invention, the assembling includes positioning the top band, removable connecting bands, and removable base band and an eraser protruding from a hole at the front of the top band, extending back inside hollow interiors of the top band and connecting bands until reaching the base band.

According to an aspect of some embodiments of the invention, there is provided a method of refilling pencil eraser case, the case including removable connecting bands and a base band, the method including: pulling a used eraser out of a hollow of portion of the case in front of the base band; removing a connecting band from behind the base band and adding it to the portion of the case in front of the base band; inserting a new eraser through the portion of the case in front of the base band, and pushing the eraser back into the hollow of the portion of the case in front of the base band until the eraser reaches a base band, the base band retaining the eraser from moving further backward.

According to an aspect of some embodiments of the invention, there is provided a method of replacing an eraser in a refillable pencil eraser case including: assembling elongated holder with a hollow interior including removable connecting bands; placing a new eraser attached to a base band into the hollow interior of the elongated holder; connecting the base band to at least one of the connecting bands; and stabilizing the eraser by the base band.

According to some embodiments of the invention, the base band is connected to a rear portion of the new eraser and wherein the placing includes inserting a front portion of the eraser through the hollow interior of the elongated holder.

According to some embodiments of the invention, the method further includes removing a used eraser before the placing.

According to some embodiments of the invention, the removing includes pulling the used eraser back out of the hollow of the elongated case.

According to some embodiments of the invention, the removing is when the used eraser is worn out to until the remaining eraser is between 2 and 4 mm from a top of the eraser to its base.

According to some embodiments of the invention, the eraser case allows for unlimited reuse through addition of a new eraser each time an eraser is worn out.

According to an aspect of some embodiments of the invention, there is provided an eraser system including: an eraser; a plurality of connecting bands a hollow elongated support for the eraser formed of a first subset of the plurality of connecting bands; a removable base band, initially attached to a back of the elongated support and attached a rear connecting band that is a furthest to the back of the plurality of connecting bands; wherein a front of the eraser protrudes from a hole at a front of elongated support, and a rear portion of the eraser extends back inside the hollow of the elongated support and through interiors of the connecting bands of the first set until reaching the base band; and a second set of the plurality of connecting bands attached to the back of the base band and maintaining a length of the elongated support.

According to some embodiments of the invention, the eraser system further includes a removable front band, with a hollow interior, forming a front end of the elongated support.

According to some embodiments of the invention, the front band has a tapered tip.

According to some embodiments of the invention, the, connecting bands and base band comprise front ends of a smaller circumference than their respective back ends, allowing them to interlock with other bands for reassembly and preventing their unintentional disassembly.

According to some embodiments of the invention, the connecting bands are configured to release from each other for disassembly and reassembly.

According to some embodiments of the invention, the base band includes a partition that acts to stabilize the eraser by preventing the eraser from moving backward.

According to some embodiments of the invention, a front side of the partition allows a worn eraser to be separated from the base band and allows a new eraser to be inserted in place against the partition in the base band.

According to some embodiments of the invention, the connecting bands combine to form an elongated support which resembles a pen.

According to some embodiments of the invention, the eraser is of a cylindrical shape that fits through the hollow of connecting bands.

According to some embodiments of the invention, the elongated support includes 4 to 12 the connecting bands.

According to some embodiments of the invention, the hole in the front of the elongated support allows for the eraser to be removed through the hole and allows for a new eraser to be inserted into the case for refilling.

According to some embodiments of the invention, the base band is removable from the eraser case together with a worn eraser.

According to some embodiments of the invention, the system further includes a new base band may be attachable to a connecting band for refilling the eraser system.

According to some embodiments of the invention, the connecting bands are manufactured from ABS plastic.

According to some embodiments of the invention, attached connecting bands have a high degree of torque-resistance.

According to some embodiments of the invention, the elongated support has a high degree of resistance to shear stress.

According to some embodiments of the invention, the elongated support has a high degree of resistance to bending effort.

According to some embodiments of the invention, the eraser is 3 to 7 mm in thickness.

According to some embodiments of the invention, the elongated support is ergonomically designed to create a comfortable grip for right handed and/or left handed individuals.

According to some embodiments of the invention, the thickness of the elongated support is between 9 mm to 15 mm.

According to some embodiments of the invention, a diameter of the top band ranges between 6 mm to 15 mm.

According to some embodiments of the invention, a diameter of the connecting bands is between 10 mm to 14 mm.

According to some embodiments of the invention, a diameter of the back of the base band is between 9 mm to 14 mm.

According to some embodiments of the invention, a width of a band is between 4 mm to 14 mm.

According to some embodiments of the invention, the length of the eraser system is between 40 to 90 mm.

According to some embodiments of the invention, a length of the front band is between 12 mm to 18 mm.

According to some embodiments of the invention, a length of each of the connecting bands is between 8 mm to 12 mm.

According to some embodiments of the invention, a length of the base band is between 12 mm to 18 mm.

According to some embodiments of the invention, a taper angle of the front band is between 10 to 20 degrees.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
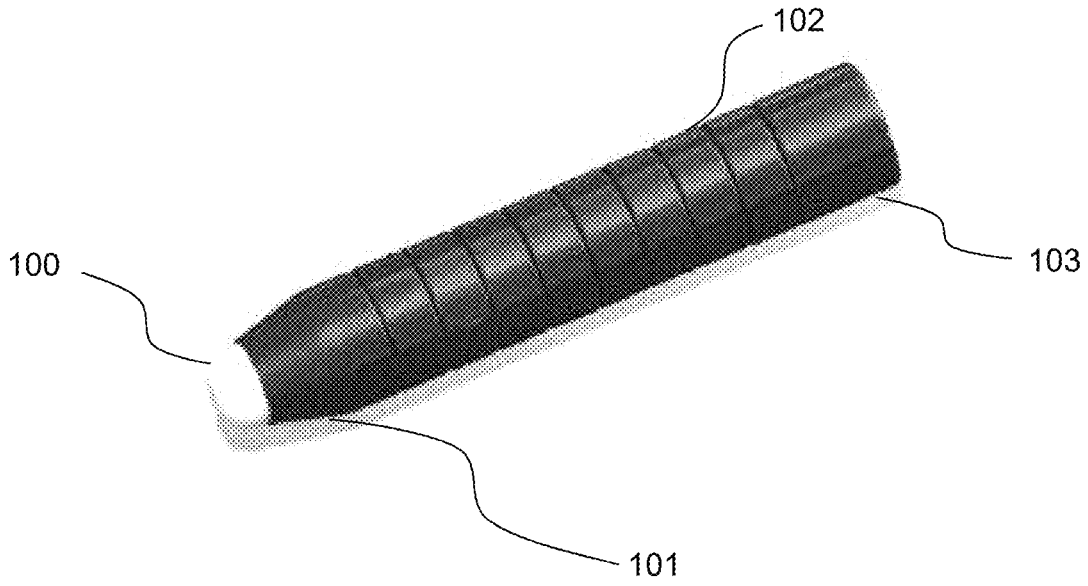
FIG. 1 is a perspective view of a refillable pencil eraser case with reassembled bands in accordance with embodiments of the present invention.

The present invention relates to a holder for a pencil eraser. More particularly but not exclusively, the present invention relates to a holder for a pencil eraser 100 with removable bands 101, 102, 103.

In some embodiments, as the eraser wears, connecting bands 102 are removed, revealing more of the eraser 100. Optionally, as the bands are removed, they are replaced at the rear end, behind the base band 103, so that the length of the holder of the eraser remains the same. Optionally, when the eraser 100 is completely worn out, a new eraser is inserted in the eraser case.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways.

FIG. 1 is a perspective view of a refillable pencil eraser case with reassembled bands in accordance with embodiments of the present invention. In some embodiments, the case for a pencil eraser 100 is comprised of removable bands

101, 102, 103. Optionally, the eraser 100 protrudes from a top band 101 and extends back inside connecting bands 102 until reaching the interior of a base band 103.

In some embodiments, the removable bands 101, 102, 103 are combined to form a ring-shaped system. Optionally, the removable bands 101, 102, 103 are combined in shape that resembles a pen. Optionally, the removable bands 101, 102, 103 have a cylindrical structure. Optionally, the interior of the removable bands 101, 102, and/or 103 is hollow. Optionally, the interior of the removable bands 101, 102, and/or 103 forms a hollow, cylindrical structure. Optionally, the hollow, cylindrical structure forming the interior of the removable bands 101, 102, and/or 103 extends from the base band 103 to the top band 101. Alternatively or additionally, the hollow, cylindrical structure forming the interior of the removable bands 101, 102, and/or 103 extends from a partition in the base band 103 to the top band 101. In some embodiments, the outer cross section of a band may be circular. Alternatively, some and/or all the bands may have a different outer cross section (for example rectangular and/or hexagonal). In some embodiments, the inner cross section of a band (e.g. of an opening through a band) may be circular and/or the cross section of an eraser refill may be circular. Alternatively or additionally, some and/or all bands may have an inner cross section that is non-circular and/or the cross section of an eraser refill may be non-circular (for example rectangular and/or hexagonal).

In some embodiments, the eraser 100 allows the erasure of graphite particles. For example, the eraser 100 may allow the erasure of the marks and/or writing of a pencil. Optionally, the eraser 100 is cylindrical. In some embodiments, the case for the pencil eraser 100 acts as a holder for the eraser 100. For example, the eraser 100 may be of a cylindrical shape that fits within the hollow, cylindrical structure of the removable bands 101, 102, and/or 103. Alternatively or additionally, the eraser 100 is of a cylindrical shape that fits within the hollow, cylindrical structure of the removable bands 101, 102, and/or 103 and extends from the base band 103 to the top band 101.

In some embodiments, the eraser holder comprises 4 to 12 connecting bands 102 in addition to a top band 101 and a base band 103. For example, the eraser holder may comprise 8 connecting bands 102 in addition to a top band 101 and a base band 103.

In some embodiments, the base band 103 acts to stabilize the eraser 100. Optionally, the base band 103 contains a partition that prevents the eraser 100 from moving toward the back end of the eraser holder. Alternatively or additionally, the partition in the base band 103 prevents the eraser 100 from moving away from the opening in the top band 101 of the eraser holder. Alternatively or additionally, the partition in the base band 103 prevents the eraser 100 from emerging from the back end of the eraser holder. Alternatively or additionally, the partition in the base band 103 locks the eraser 100 in place. Optionally, the partition is located in the middle of the base band 103. In some embodiments, partition may completely and/or partially block the hollow portion of the base band. Alternatively or additionally, the base band may be tightly wrapped around the eraser and/or attached to the eraser.

In some embodiments, as the eraser wears, the top band 101 is removed from the eraser case. Optionally, a connecting band 102 is then removed from the eraser case, revealing more of the eraser 100. Optionally, after a connecting band 102 is removed, it is placed at the rear end of the eraser holder, behind the base band 103, so that the length of the eraser holder remains unchanged.

In some embodiments, the first connecting band 102 removed from the eraser case, after the placement of a new eraser in the eraser case, is placed directly behind the base band 103. Optionally, each subsequent connecting band 102 removed from the eraser case is placed, in turn, behind the band that is furthest back. Optionally, the top band 101 is then replaced in its position at the front of the eraser case.

In some embodiments, when the eraser 100 is worn out to the point that the remaining eraser is between 2 and 4 mm from the top of the eraser to its base, a connecting band 102 is removed and is replaced at the rear end of the eraser holder, behind the base band 103, so that the length of the eraser holder remains unchanged. For example, when the eraser 100 is worn out to the point that the remaining eraser measures approximately 3 mm from the top of the eraser to its base, a connecting band 102 is removed and is replaced at the rear end of the eraser holder, behind the base band 103, so that the length of the eraser holder remains unchanged. Alternatively or additionally, the length of area of the grip of the user of the eraser holder remains unchanged.

In some embodiments, when the eraser 100 is completely worn out, a new eraser is inserted into the eraser case. Optionally, the eraser holder allows for unlimited reuse through the addition of a new eraser 100 each time an eraser 100 is worn out. Optionally, the eraser holder allows for the easy removal of the worn out eraser 100 and/or the easy insertion of a new eraser 100.

Alternatively or additionally, the bands 101, 102, and/or 103 automatically cause the eraser 100 to move forward toward the top band 101 as the eraser 100 wears. Optionally, the regulation of the position of the eraser is performed manually by the user removing a connecting band 102 and inserting it at the rear end of the eraser holder, behind the base band 103. Optionally, the removal and replacement of the bands 101, 102, and/or 103 is performed quickly and easily, with minimal disturbance to the user. For example, the removal and replacement of the bands 101, 102, and/or 103 may be facilitated by an easy release and/or an easy reattachment. Optionally, bands 101, 102, and/or 103 are not tightly joined to each other. Optionally, bands 101, 102, and/or 103 are not tightly joined to each other contributes to the ease of release and reattachment of bands 101, 102, and/or 103. Optionally, the bands 101, 102, and/or 103 interlock and/or interfit with one another. Optionally, the interlocking and/or interfitting of bands 101, 102, and/or 103 with one another protects them from falling off unintentionally, despite their ease of release.

In some embodiments, the bands 101, 102 and 103 are manufactured from ABS plastic. Optionally, the individual bands 101, 102 and 103 have a high degree of torque-resistance. Alternatively or additionally, the eraser holder as a whole has a high degree of torque-resistance. Optionally, the individual bands 101, 102 and 103 have a high degree of resistance to shear stress. Alternatively or additionally, the eraser holder as a whole has a high degree of resistance to shear stress. Optionally, the individual bands 101, 102 and 103 have a high degree of resistance to bending effort. Alternatively or additionally, the eraser holder as a whole has a high degree of resistance to bending effort.

In some embodiments, erasure is carried out by holding the eraser holder in one hand while applying force to the eraser holder such that torque is applied to the eraser's vertex. Optionally, the eraser holder is designed so that it may be held with equal ease in the right and left hands. Optionally, the eraser 100 is a hard eraser, like that typically found at the end of a pencil and/or pen. Optionally, the eraser 100 is 3 to 7 mm in thickness and/or 7 to 14 mm in thickness.

For example, the eraser 100 may be 5 mm in thickness. Optionally, the eraser 100 is a high quality eraser. Optionally, the eraser holder is ergonomically designed to create a comfortable grip. Optionally, the comfort of the grip is facilitated by the dimensions detailed in the discussion of the subsequent figures.

Figure 2:
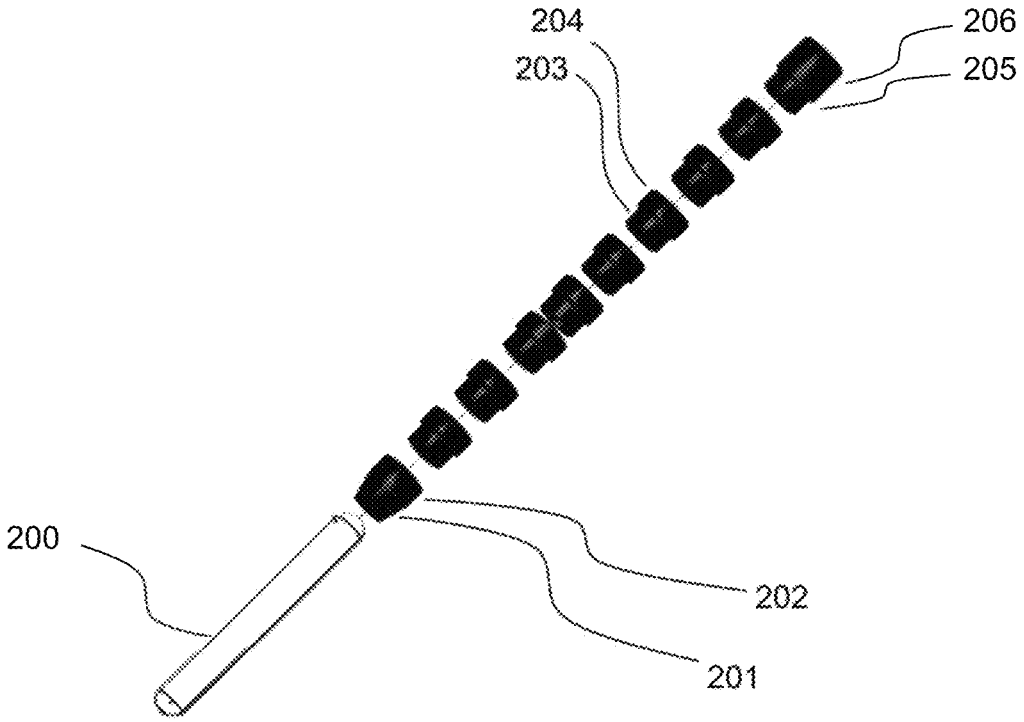
FIG. 2 is an exploded perspective view of a banded eraser, in accordance with embodiments of the present invention, illustrating the specific arrangement of the components of the banded eraser.

FIG. 2 is an exploded perspective view of a banded eraser, in accordance with embodiments of the present invention, illustrating the specific arrangement of the components of the banded eraser. In some embodiments, the eraser 200 is of a cylindrical shape that fits within the hollow, cylindrical structure of the removable bands. Optionally, once inserted within the removable bands, the eraser 200 protrudes from the front 201 of the top band. Optionally, the circumference 202 of the top band is larger than the circumference of the front 201 of the top band. Optionally, the eraser 200 extends from the front 201 of the top band back towards the front 205 of the base band.

In some embodiments, the circumference of the front 203 of the connecting bands is smaller than the circumference of the back 204 of the connecting bands, allowing the front 203 of the connecting bands to fit inside of the back 204 of the connecting bands. Optionally, the fronts 203 of the connecting bands fit inside of the backs 204 of the connecting bands in an interlocking and/or interfitting manner.

In some embodiments, the circumference of the front 205 of the base band is smaller than the circumference of the back 206 of the base band, allowing the front 205 of the base band to fit inside of the back 206 of the base band. Optionally, the front 205 of the base band fits inside of the back 206 of the base band in an interlocking and/or interfitting manner.

Figure 3:
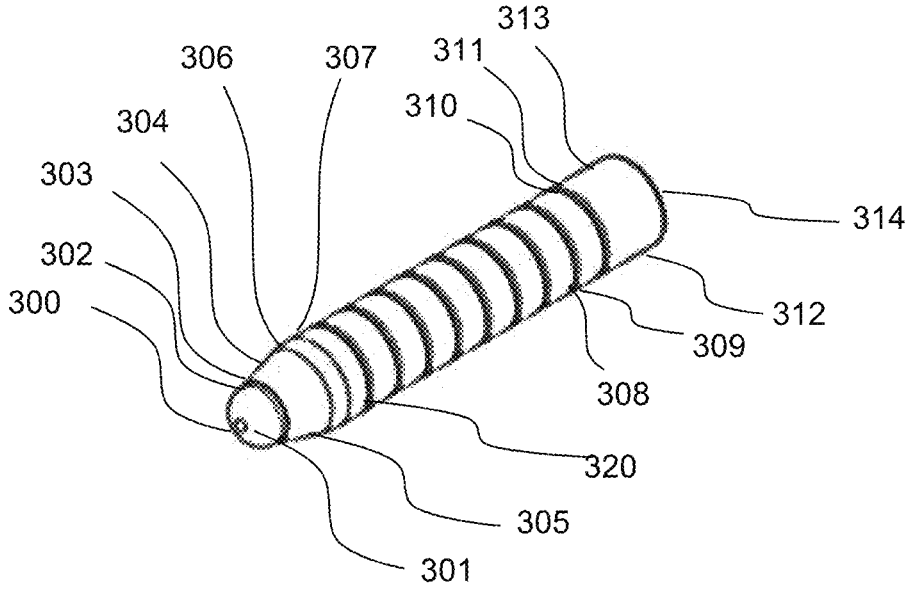
FIG. 3 is a perspective view of a refillable pencil eraser case with reassembled bands in accordance with embodiments of the present invention.

FIG. 3 is a perspective view of a refillable pencil eraser case with reassembled bands in accordance with embodiments of the present invention. In some embodiments, the vertex 300 and body 301 of an eraser protrude from the front of top band 304 305 with circumference 302. Optionally, the circumference of the back 320 of the top band is larger than the circumference of the front 303 of the top band. Optionally, the circumference increases at a different rate between the front 303 of the top band and a line 306, and/or between a line 307, and/or the back 320 of the top band. Alternatively or additionally, the circumference of the top band stops increasing at line 306 or at line 307.

In some embodiments, a small space is visible between the back 308 of one connecting band and the front 309 of the connecting band into which it is inserted. Optionally, a small space is visible between the back 310 of one connecting band and the front 311 of the base band 312, 313, 314 into which it is inserted.

Figure 4:
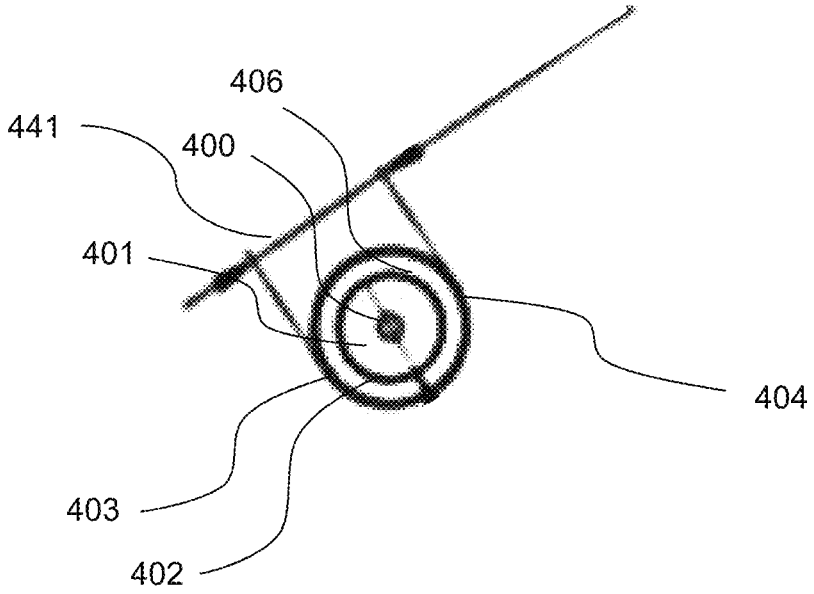
FIG. 4 is an enlarged cross-sectional view taken along circumference 302 of FIG. 3 of a refillable pencil eraser case with reassembled bands in accordance with embodiments of the present invention.

FIG. 4 is an enlarged cross-sectional view taken along circumference 302 of FIG. 3 of a refillable pencil eraser case with reassembled bands in accordance with embodiments of the present invention. In some embodiments, the thickness of the grip, represented by the diameter 441 from point 403 to point 404 along the larger circumference of the top band, is ergonomically designed to increase the comfort of the grip. Optionally, the distance from point 403 to point 404, is 9 mm to 15 mm. For example, the body thickness of the grip, represented by the distance from point 403 to point 404, may range between 2 to 10 mm and/or between 10 to 20 mm for example it may be 12 mm.

In some embodiments, the diameter of the front of the top band, represented by the distance from point 402 to point 406, is 6 mm to 10 mm. For example, the diameter of the front of the top band, represented by the distance from point 402 to point 406, may be 7.8 mm. In some embodiments, the vertex 400 of the eraser 401 emerges from the front point 402 of the top band.

Figure 5:
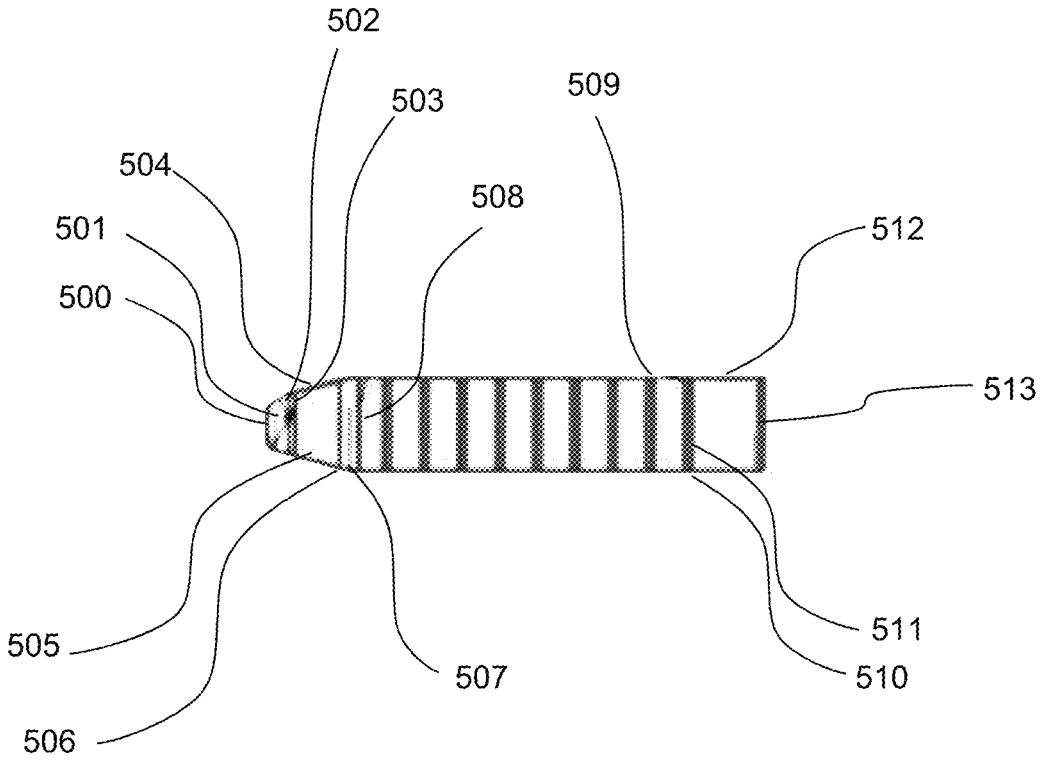
FIG. 5 is a longitudinal section of a refillable pencil eraser case with reassembled bands in accordance with embodiments of the present invention.

FIG. 5 is a longitudinal section of a refillable pencil eraser case with reassembled bands in accordance with embodiments of the present invention. In some embodiments the length of the eraser holder, from the vertex 500 of the eraser 501 to the back of the base band 513, is between 40 mm and 90 mm. For example, the length of the eraser holder, from vertex 500 of the eraser 501 to the back of the base band 513, may be 65 mm. Alternatively or additionally, the length of the eraser holder, from the front 502 of the top band 504 to the back of the base band 513, may be 65 mm. Optionally, when no additional components are added to the bands other than the eraser 100, the length of the eraser holder, from the front 502 of the top band 504 to the back of the base band 513, is equal to the combined length of the bands when interlocked and/or interfitted.

In some embodiments, the distance from the vertex 500 of the eraser 501 to a line 507 in the middle of the back portion 506 of the top band 504, 505 is 7 mm to 13 mm. For example, the distance from the vertex 500 of the eraser 501 to a line 507 in the middle of the back portion 506 of the top band may be 10 mm. Alternatively or additionally, the distance from the front 502 of the top band 504 to a line 507 in the middle of the back portion 506 of the top band may be 10 mm.

In some embodiments, the front 502 of the top band 504, 505 has a radius of curvatures between 2 mm and 4 mm. For example, the front 502 of the top band 504, 505 may have a radius of curvatures of 3 mm. In some embodiments, a line 503 just behind the front 502 of the top band 504, 505 has a radius of curvatures between 0.05 mm and 0.2 mm. For example, line 503 just behind the front 502 of the top band 504, 505 may have a radius of curvatures of 0.1 mm.

In some embodiments, the back 508 of the top band 504, 505 has a radius of curvatures between 8 mm and 12 mm. For example, the back 508 of the to band 504, 505 may have a radius of curvatures of 10 mm. In some embodiments, the back 510 of a connecting band has a radius of curvatures between 0.3 mm and 0.7 mm. For example, the back 510 of a connecting band may have a radius of curvatures of 0.5 mm.

In some embodiments, the length of a connecting band 511, from the front 509 of a connecting band to the back 510 of a connecting band, is between 3 mm and 7 mm. For example, the length of a connecting band 511 may be 5 mm. In some embodiments, the length of a base band 512, from the front 511 of a base band 512 to the back 513 of a base band, is between 8 mm and 12 mm. For example, the length of a base band 512 may be 10 mm.

In some embodiments, the diameter of the back 513 of a base band 512 is between 10 mm and 14 mm. For example, the diameter of the back 513 of a base band 512 may be 12 mm.

Figure 6:
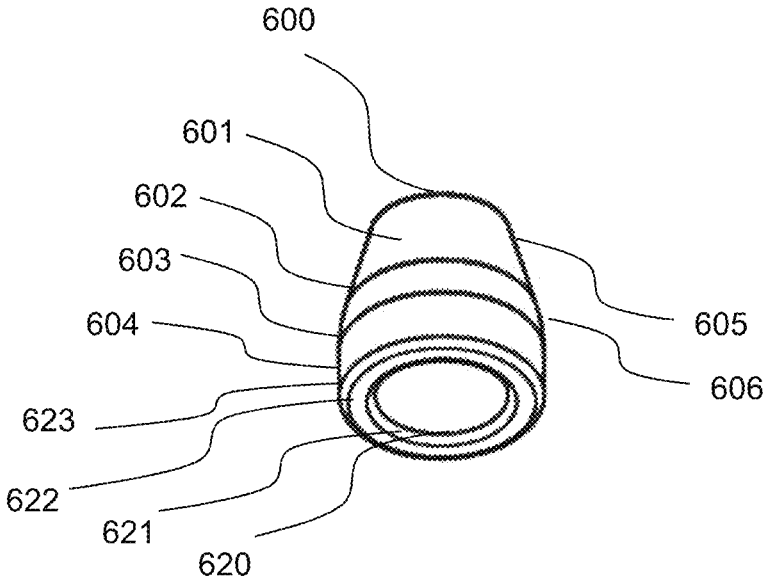
FIG. 6 is a perspective view of the top band 101 of FIG. 1 of a refillable pencil eraser case with reassembled bands in accordance with embodiments of the present invention.

FIG. 6 is a perspective view of the top band 101 of FIG. 1 of a refillable pencil eraser case with reassembled bands in accordance with embodiments of the present invention. In some embodiments, the circumference increases from the front 600 of the top band 601 to the back 623 of the top band 601. Optionally, the circumference increases at different rates from the front 600 of the top band 601 to line 602 to line 603 to the back 623 of the top band 601.

In some embodiments, the hollow interior space surrounded by interior rings 620, 621 and 622 has the same circumference in both the front 605 part and the back 606 part of the top band 601. Alternatively or additionally, the hollow interior space surrounded by interior rings 620, 621 and 622 has a different circumference in the front part than in the back part of the top band 601.

Figure 7:
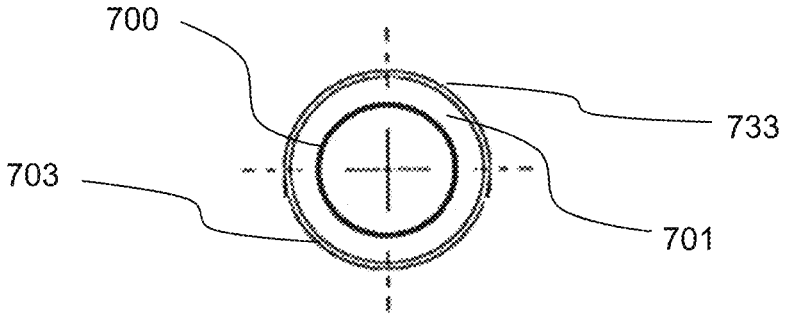
FIG. 7 is an enlarged cross-sectional view taken along circumference 622 of FIG. 6 of the top band of a refillable pencil eraser case with reassembled bands in accordance with embodiments of the present invention.

FIG. 7 is an enlarged cross-sectional view taken along circumference 622 of FIG. 6 of the top band of a refillable pencil eraser case with reassembled bands in accordance with embodiments of the present invention. In some embodiments, the diameter from point 703 to point 733 along the larger circumference of the top band 701 is 9 mm to 15 mm. For example, the distance from point 703 to point 733 along the larger circumference of the top band 701, may be 12 mm. Optionally, the diameter of the top band 701 is smaller at the front end 700 of the top band.

Figure 8:
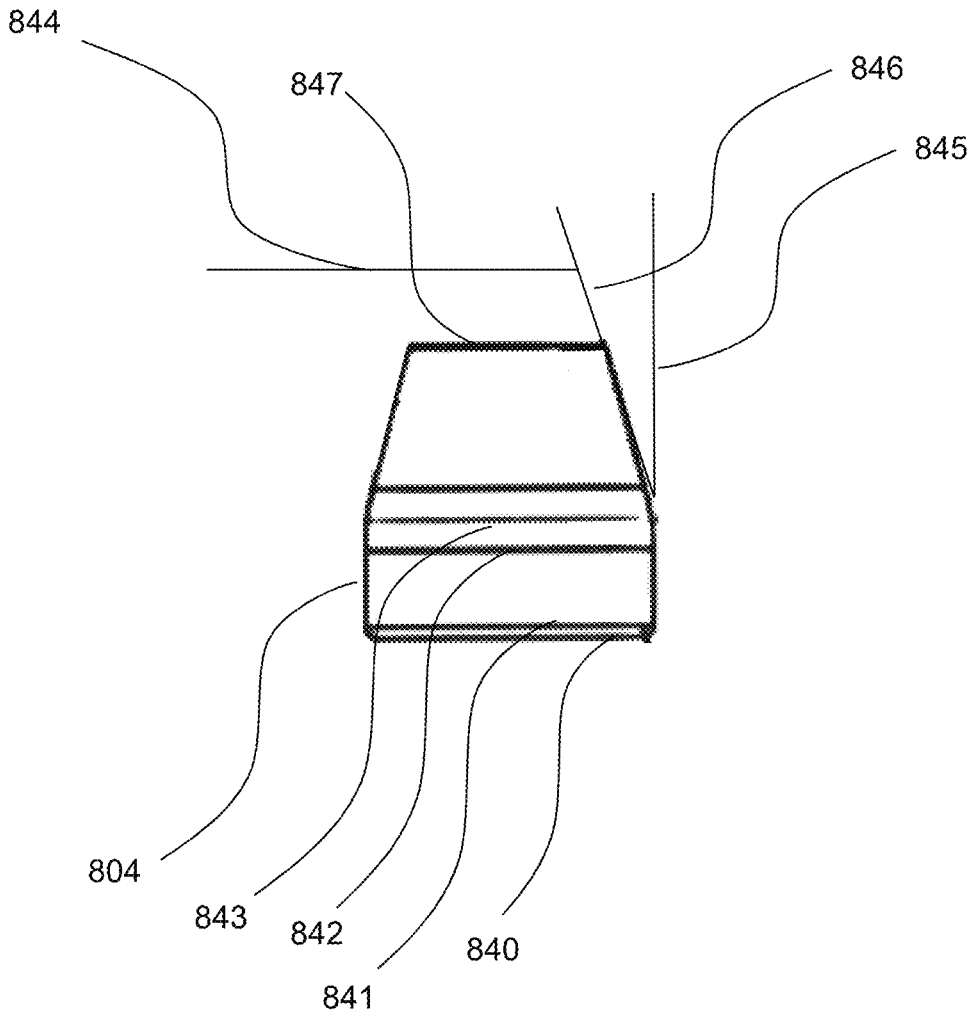
FIG. 8 is a plan view of the top band of FIG. 6 of a refillable pencil eraser case with reassembled bands in accordance with embodiments of the present invention.

FIG. 8 is a plan view of the top band of FIG. 6 of a refillable pencil eraser case with reassembled bands in accordance with embodiments of the present invention. In some embodiments the length from the back 840 of the top band 804 to the intermediate line 843 of the top band 804 is 3 mm to 7 mm. For example, the length from the back 840 of the top band 804 to the intermediate line 843 of the top band 804 may be 5 mm. In some embodiments the length from the intermediate line 843 of the top band 804 to a line 844 at the front of top band 804 is 8 mm to 12 mm. For example, the length from the intermediate line 843 of the top band 804 to a line 844 at the front of top band 804 may be 10 mm.

In some embodiments the total length of the top band from the back 840 of the top band 804 to a line 847 at the front of top band 804 is 12 mm to 18 mm. For example, the length of the top band 804 may be 15 mm.

In some embodiments, a line 847 at the front of top band 804, has a radius of curvatures between 0.05 mm and 0.2 mm. For example, line 847 at the front of top band 804 may have a radius of curvatures of 0.1 mm. In some embodiments, a line 841 at the back of top band 804, has a radius of curvatures between 0.3 mm and 0.7 mm. For example, line 841 at the back of top band 804 may have a radius of curvatures of 0.5 mm. In some embodiments, a line 842 close to the back of top band 804, has a radius of curvatures between 8 mm and 12 mm. For example, line 842 close to the back of top band 804 may have a radius of curvatures of 10 mm.

In some embodiments, the outer side 846 of top band 804 turns in toward the center of top band 804 at an angle of 15 degrees from a line 845 perpendicular to the back 840 of top band 804.

Figure 9:
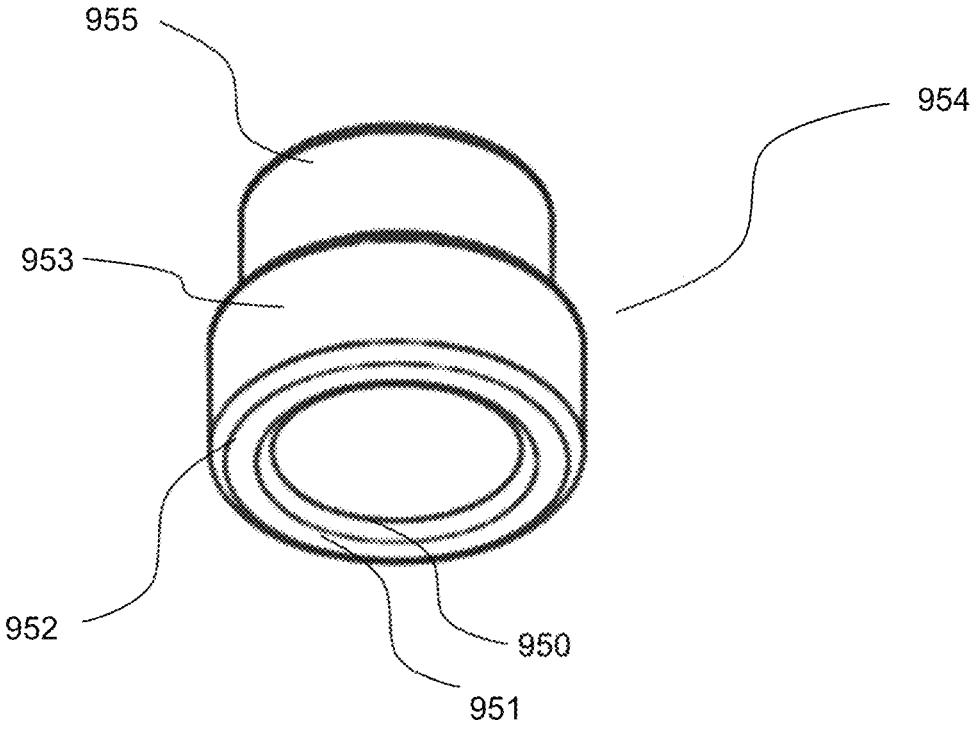
FIG. 9 is a perspective view of a connecting band 102 of FIG. 1 of a refillable pencil eraser case with reassembled bands in accordance with embodiments of the present invention.

FIG. 9 is a perspective view of a connecting band 102 of FIG. 1 of a refillable pencil eraser case with reassembled bands in accordance with embodiments of the present invention. In some embodiments, the front part 955 of the connecting band 954 has a smaller circumference than the back part 953 of the connecting band 954.

In some embodiments, the hollow interior space surrounded by rings 950, 951 and 952 has the same circumference in both the front part 955 and the back part 953 of the connecting band 954. Alternatively or additionally, the hollow interior space surrounded by rings 950, 951 and 952 has a different circumference in the front part 955 than in the back part 953 of the connecting band 954.

Figure 10:
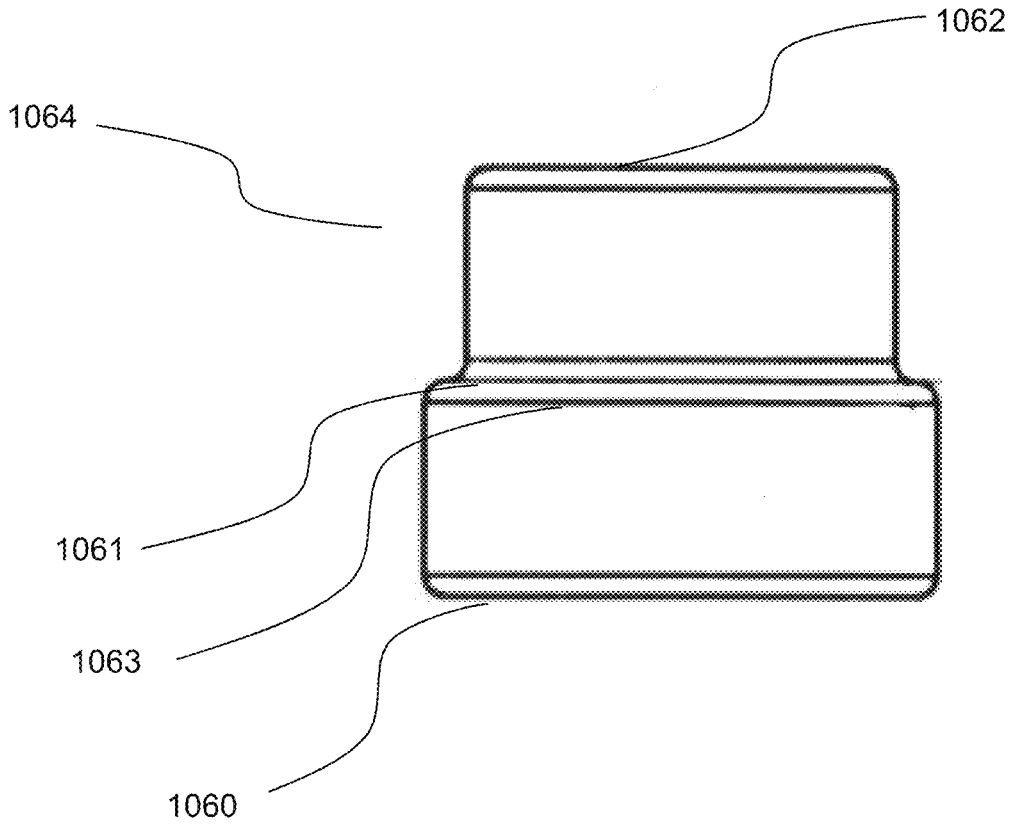
FIG. 10 is a plan view of the connecting band of FIG. 9 of a refillable pencil eraser case with reassembled bands in accordance with embodiments of the present invention.

FIG. 10 is a plan view of the connecting band of FIG. 9 of a refillable pencil eraser case with reassembled bands in accordance with embodiments of the present invention. In some embodiments, the front part 1062 of the connecting band 1064 has a smaller circumference than the back part 1060 of the connecting band 1064.

In some embodiments, the distance from the back 1060 of the connecting band 1064 to a line 1061, located between the front part and back part of the connecting band 1064, is 4 mm to 6 mm. For example, the distance from the back 1060 of the connecting band 1064 to line 1061 on the connecting band 1064 may be 5 mm.

In some embodiments, the distance from the front 1062 of the connecting band 1064 to a line 1061, located between the front part and back part of the connecting band 1064, is 4 mm to 6 mm. For example, the distance from the front 1062 of the connecting band 1064 to line 1061 on the connecting band 1064 may be 5 mm.

In some embodiments the total length of the connecting band 1064 from the front 1062 of the connecting band 1064 to the back 1060 of the connecting band 1064 is 8 mm to 12 mm. For example, the length of the connecting band 1064 may be 10 mm.

In some embodiments, the line 1063 located in the back part of the connecting band 1064 close to the middle of the connecting band 1064 has a radius of curvatures between 0.3 mm and 0.7 mm. For example, the line 1063 located in the back part of the connecting band 1064 may have a radius of curvatures of 0.5 mm.

Figure 11:
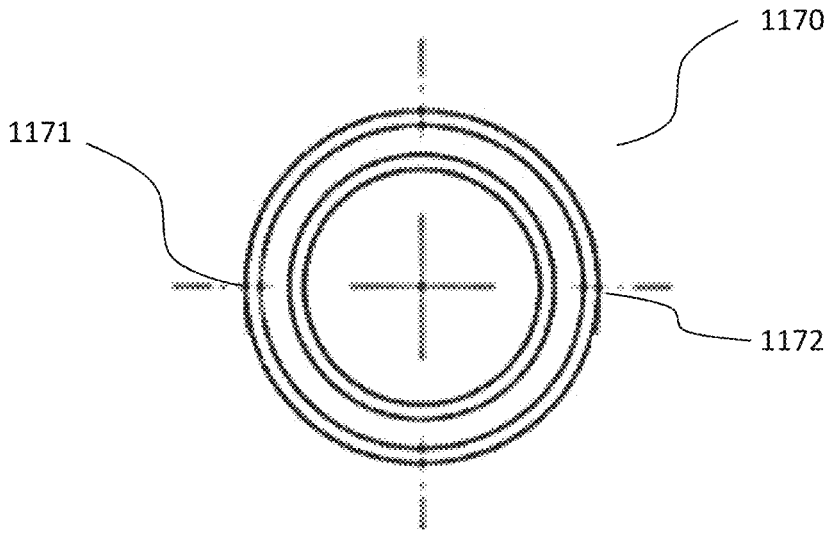
FIG. 11 is an enlarged cross-sectional view taken along circumference 953 of FIG. 9 of the connecting band of a refillable pencil eraser case with reassembled bands in accordance with embodiments of the present invention.

FIG. 11 is an enlarged cross-sectional view taken along circumference 953 of FIG. 9 of the connecting band of a refillable pencil eraser case with reassembled bands in accordance with embodiments of the present invention. In some embodiments, the diameter of the connecting band 1170, measured from point 1171 on the outer ring of the connecting band 1170 to point 1172 on the opposing side of the outer ring of the connecting band 1170 is 10 mm to 14 mm. For example, the diameter of the outer ring of the connecting band 1170 may be 12 mm.

Figure 12:
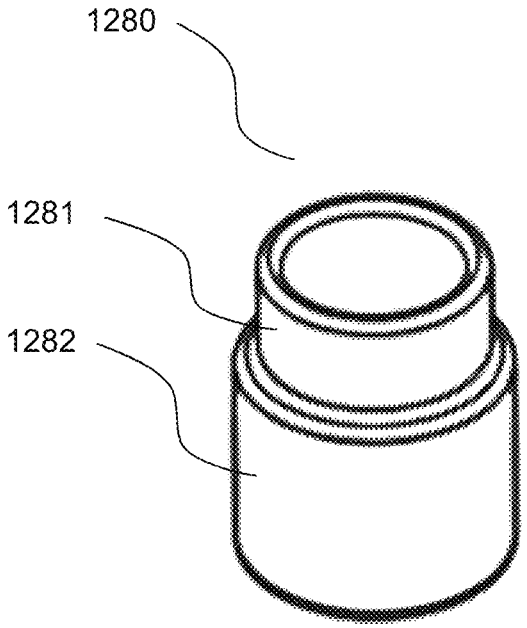
FIG. 12 is a perspective view of the base band 103 of FIG. 1 of a refillable pencil eraser case with reassembled bands in accordance with embodiments of the present invention.

FIG. 12 is a perspective view of the base band 103 of FIG. 1 of a refillable pencil eraser case with reassembled bands in accordance with embodiments of the present invention. In some embodiments, the front part 1281 of the base band 1280 has a smaller circumference than the back part 1282 of the base band 1280.

Figure 13:
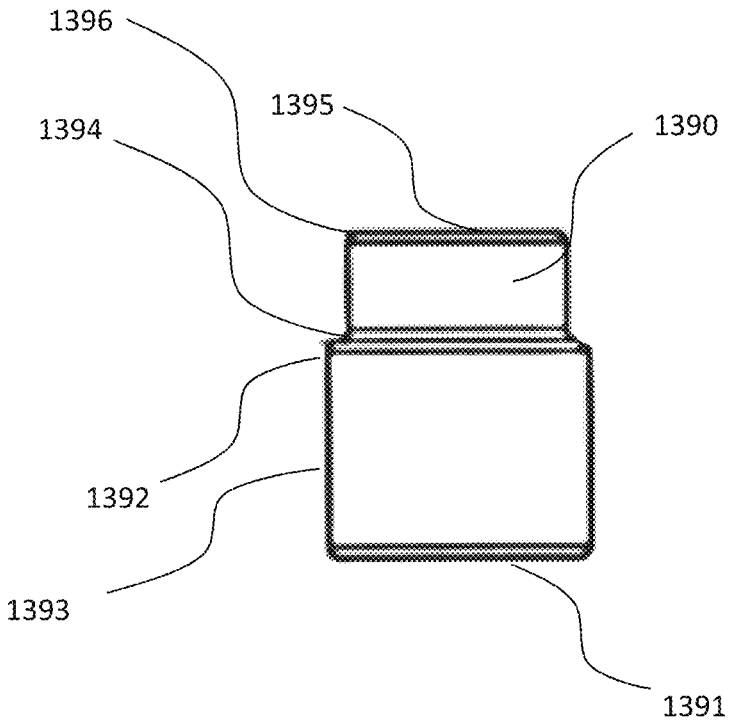
FIG. 13 is a plan view of the base band of FIG. 12 of a refillable pencil eraser case with reassembled bands in accordance with embodiments of the present invention.

FIG. 13 is a plan view of the base band of FIG. 12 of a refillable pencil eraser case with reassembled bands in accordance with embodiments of the present invention. In some embodiments, the front part 1396 of the base band 1390 has a smaller circumference than the back part 1393 of the base band 1390.

In some embodiments, the back part 1393 of the base band 1390 is longer than the front part 1396 of the base band 1390. Optionally, the distance from the back 1391 of the base band 1390 to a line 1394, located between the front part 1396 and back part 1393 of the base band 1390, is 8 mm to 12 mm. For example, the distance from the back 1391 of the base band 1390 to line 1394 on the base band 1390 may be 10 mm.

In some embodiments, the distance from the front 1395 of the base band 1390 to a line 1394, located between the front part 1396 and back part 1393 of the base band 1390, is 4 mm to 6 mm. For example, the distance from the front 1395 of the base band 1390 to line 1394 on the base band 1390 may be 5 mm.

In some embodiments the total length of the base band 1390 from the front 1395 of the base band 1390 to the back 1391 of the base band 1390 is 12 mm to 18 mm. For example, the length of the base band 1390 may be 15 mm.

In some embodiments, the line 1392 located in the back part of the base band 1390 close to the middle of the base band 1390 has a radius of curvatures between 0.3 mm and 0.7 mm. For example, the line 1392 located in the back part of the base band 1390 may have a radius of curvatures of 0.5 mm.

Figure 14:
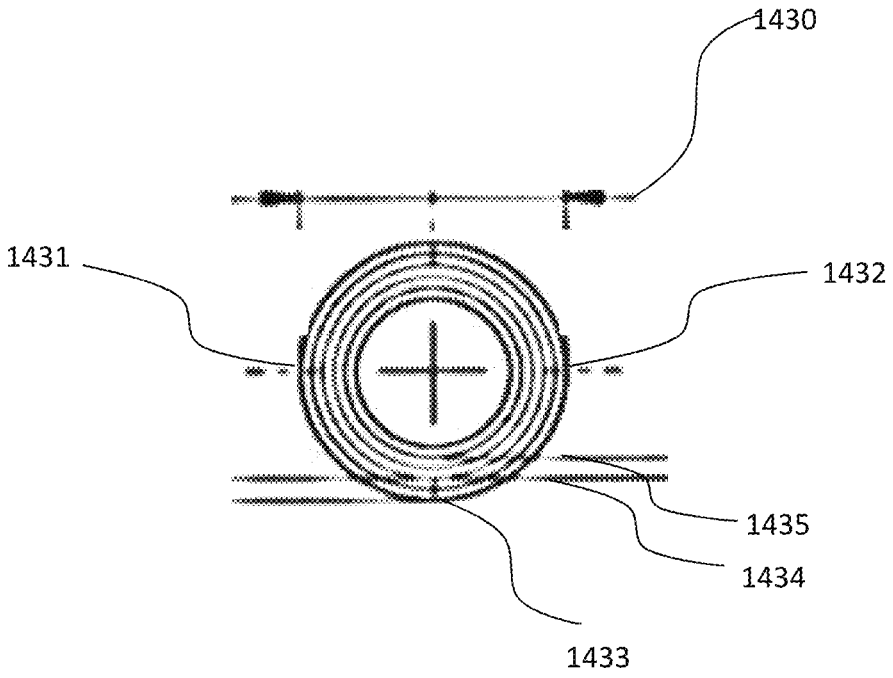
FIG. 14 is an enlarged cross-sectional view taken along circumference 1287 of FIG. 12 of the base band of a refillable pencil eraser case with reassembled bands in accordance with embodiments of the present invention.

FIG. 14 is an enlarged cross-sectional view taken along circumference 1287 of FIG. 12 of the base band of a refillable pencil eraser case with reassembled bands in accordance with embodiments of the present invention.

In some embodiments, the diameter of the base band 1430, measured from point 1431 on the outer ring of the base band 1430 to point 1432 on the opposing side of the outer ring of the base band 1430 is 10 mm to 14 mm. For example, the diameter of the outer ring of the base and 1170 may be 12 mm.

In some embodiments, the distance from the outside 1433 of the outermost ring of the base band 1430 to the inside 1434 of the adjoining ring is 0.8 mm to 1.2 mm. For example, the distance from the outside 1433 of the outermost ring of the base band 1430 to the inside 1434 of the adjoining ring may be 1 mm.

In some embodiments, the distance from the inside 1434 of the first interior ring of the base band 1430 to the inside 1435 of the third interior ring is 0.8 mm to 1.2 mm. For example, the distance from the inside 1434 of the first interior ring of the base band 1430 to the inside 1435 of the third interior ring may be 1 mm.

Figure 15:
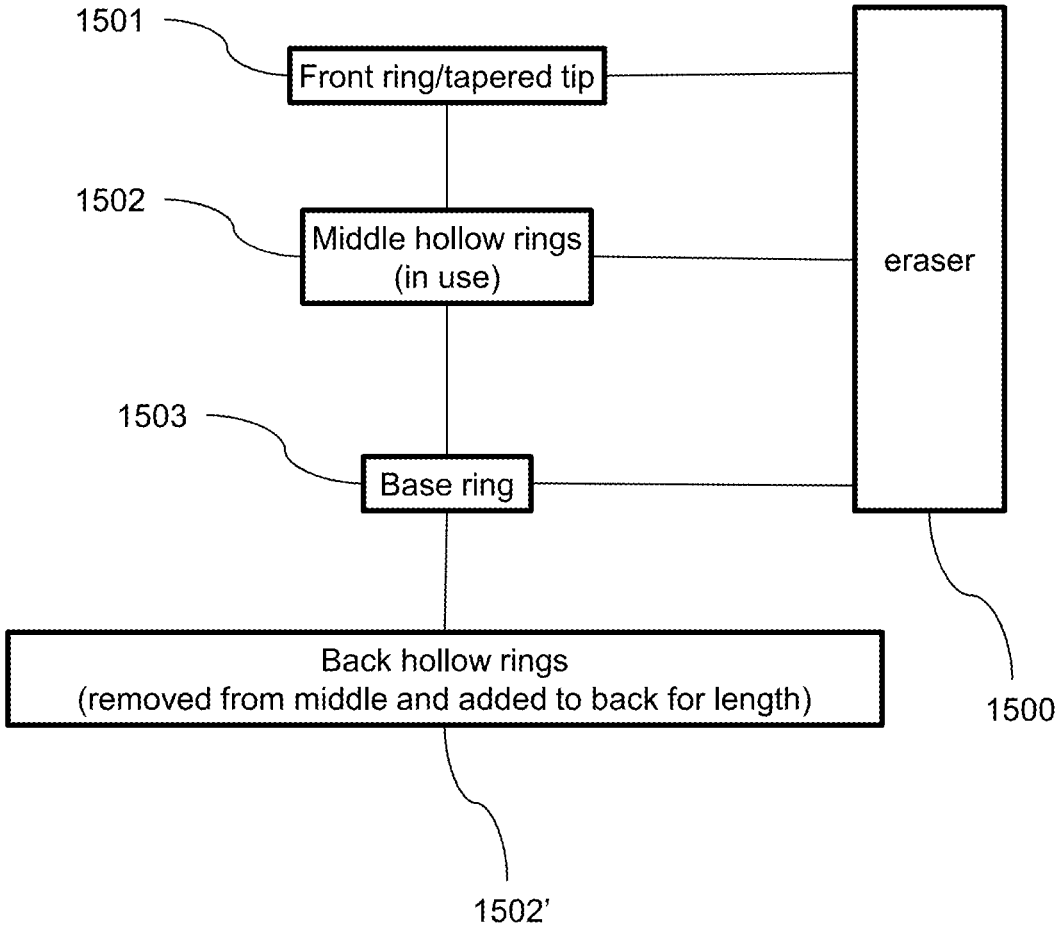
FIG. 15 is an exemplary block diagram illustrating the relationship between the components of a refillable pencil eraser case with reassembled bands in accordance with embodiments of the present invention.

FIG. 15 is an exemplary block diagram illustrating the relationship between the components of a refillable pencil eraser case with reassembled bands in accordance with embodiments of the present invention. In some embodiments, a front (top) ring 1501 (band) forms the front end of the eraser case. Optionally, the front (top) ring 1501 (band) has a tapered tip. Optionally, middle (connecting) rings 1502 (bands) attach to the front (top) ring (band). Optionally, the rings 1501, 1502, 1502' (bands) have a hollow interior. Optionally, middle (connecting) rings 1502 (bands) are in use, supporting part or all of the eraser.

In some embodiments, a base ring 1503 (band) attaches to the middle (connecting) ring 1502 (band) that is furthest to the back. Optionally, as the eraser 1500 wears, connecting rings 1502 (bands) are placed behind the base ring 1503 (band) as back hollow rings 1502' (bands). Optionally, the connecting rings 1502 (bands) are placed behind the base ring (band) 1502 as back hollow rings 1502' (bands) when they are not in use as middle rings 1502 (bands). For example, after an eraser 1500 has worn, a middle (connecting) ring 1502 (band) may be removed from the middle section of the eraser case, revealing additional eraser 1500, and added to the back of the eraser case, behind the base ring 1502' (band) for length. Optionally, middle (connecting) rings behind the base ring 1502' (bands) are not in use to support part or all of the eraser and function only to maintain the length of the eraser holder.

Figure 16:
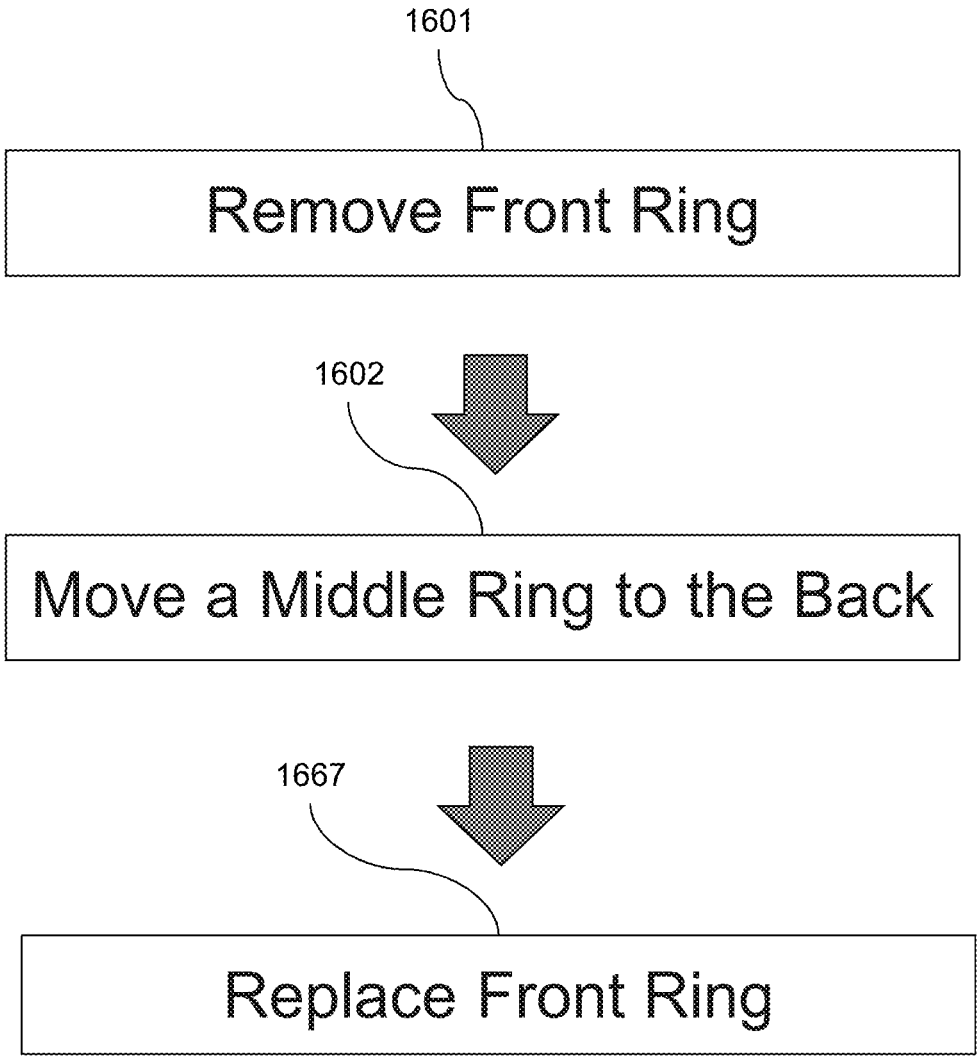
FIG. 16 is a flow chart illustration of a method of revealing more of an eraser as it wears in a refillable pencil eraser case with reassembled bands in accordance with embodiments of the present invention.

FIG. 16 is a flow chart illustration of a method of revealing more of an eraser as it wears in a refillable pencil eraser case with reassembled bands in accordance with embodiments of the present invention. In some embodiments, the process of revealing more of an eraser begins with the removal 1601 of the front ring (band) from the eraser case. Optionally, a middle (connecting) ring (band) is then removed from the eraser case, for example shortening the case and/or revealing more of the eraser. Optionally, the middle (connecting) ring (band) that was removed from the eraser case is then placed 1602 in at the back end of the rings (bands) and the front band replaced 1667 at the front end of the remaining middle rings. Optionally, as the eraser continues to wear, further middle (connecting) rings (band) are removed 1601 from the eraser case. Optionally, each ring is placed 1602, in turn, behind the ring (band) that is furthest back. Optionally, after moving 1602 a middle ring, the front ring (band) is then replaced 1667 in its position at the front of the eraser case.

Figure 17:
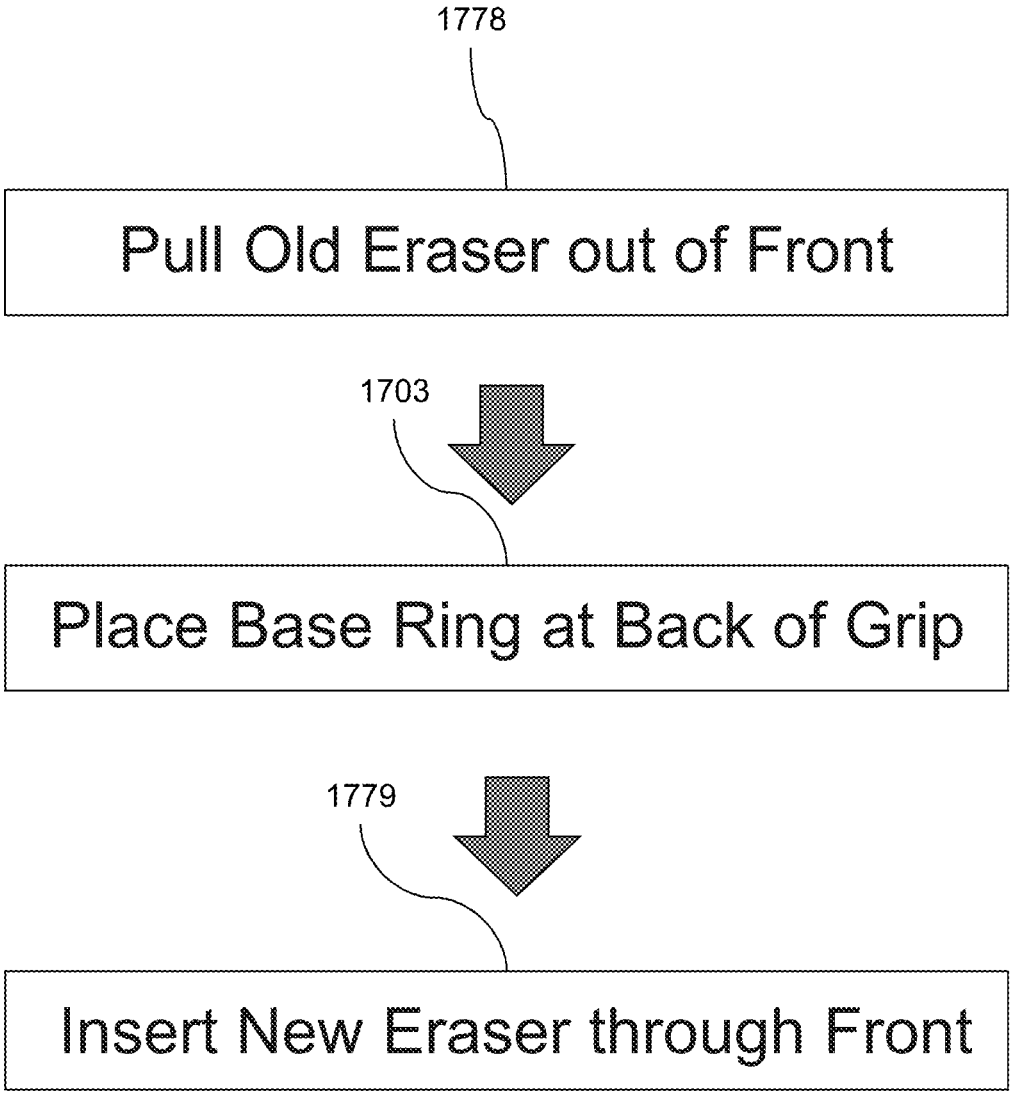
FIG. 17 is a flow chart illustration of a method of replacing an eraser in a refillable pencil eraser case with reassembled bands in accordance with embodiments of the present invention.

FIG. 17 is a flow chart illustration of a method of replacing an eraser in a refillable pencil eraser case with reassembled bands in accordance with embodiments of the present invention. In some embodiments, an old eraser is pulled out 1778 of the front end of the eraser case. Optionally, a new eraser is then inserted 1779 through the front end of the eraser case. Optionally, a base ring (band) is placed 1703 at the back of the eraser case (grip), for example before the new eraser may be inserted 1779 through the front end of the eraser case. Alternatively or additionally, the base ring (band) is already in place at the back of the eraser case (grip) before the replacement of the eraser is initiated.

Figure 18:
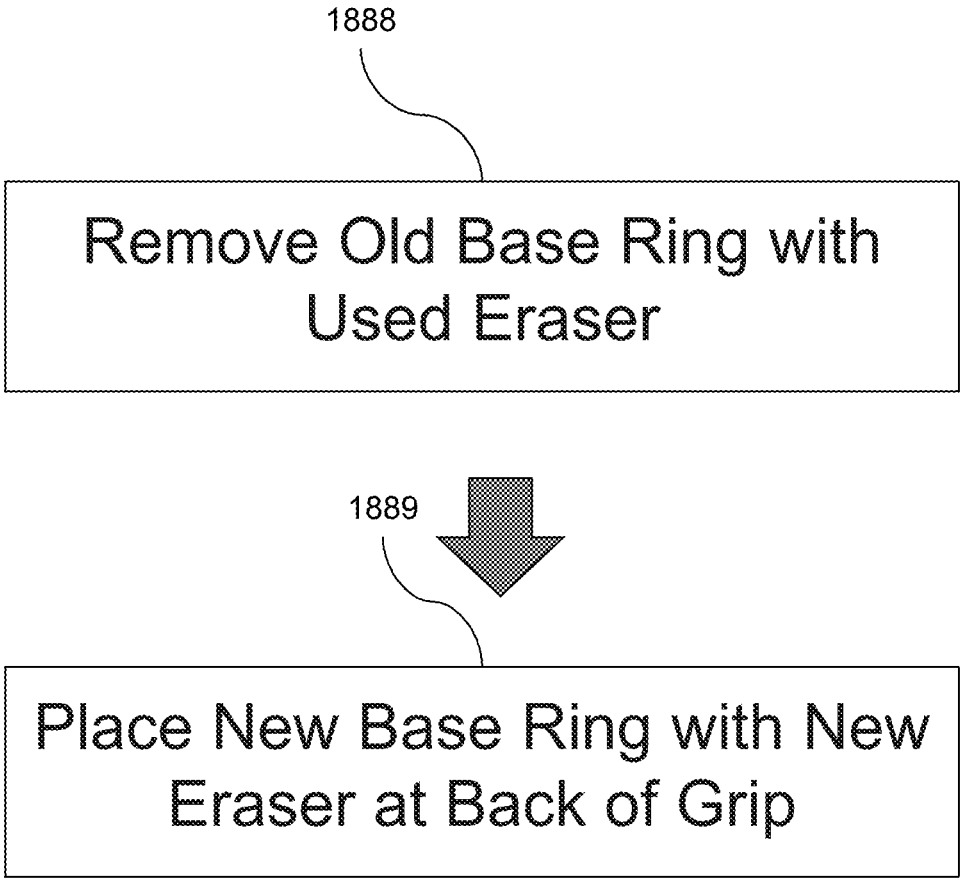
FIG. 18 is a flow chart illustration of an alternative method of replacing an eraser in a refillable pencil eraser case with reassembled bands in accordance with embodiments of the present invention.

FIG. 18 is a flow chart illustration of an alternative method of replacing an eraser in a refillable pencil eraser case with reassembled bands in accordance with embodiments of the present invention. In some embodiments, the base ring (band) is removed 1888 together with the used eraser. Optionally, a new base ring together with a new eraser is then placed 1889 at the back of the eraser case (grip).

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method of maintaining a length of an eraser case comprising:

assembling a plurality of connecting bands in front of a base band to define an elongated hollow portion of the eraser case, said base band retaining an eraser in said elongated hollow portion;

removing one band of said plurality of connecting bands, thus shortening the elongated hollow portion of the eraser case and revealing a portion of the eraser; and placing the one band behind the base band as a back band thereby maintaining the length of the eraser case.

2. The method of claim 1, wherein the eraser case further includes a top band, the method further comprising:

removing the top band before said removing the one band and replacing the top band at the front of the elongated hollow portion.

3. The method of claim 2, further comprising: repeating said removing, placing and replacing after further wear of the eraser by removing a further band of said plurality of connecting bands from in front of the base band and repositioning the further band behind the base band.

4. The method of claim 2, wherein said assembling includes positioning said top band, said plurality of connecting bands, and said base band with the eraser protruding from a hole at the front of the top band, the eraser extending back inside hollow interiors of the top band and the plurality of connecting bands until reaching the base band.

5. The method of claim 1, further comprising:

pulling the eraser out of said elongated hollow portion of the eraser case in front of the base band;

removing said back band from behind the base band and adding it to the portion of the eraser case in front of the base band;

inserting a new eraser through the portion of the eraser case in front of the base band; and pushing the new eraser back into the elongated hollow portion of the eraser case in front of the base band until the new eraser reaches the base band, said base band retaining the new eraser from moving further backward.

* * * * *